US007044210B2

(12) United States Patent
Usui

(10) Patent No.: US 7,044,210 B2
(45) Date of Patent: May 16, 2006

(54) HEAT TRANSFER PIPE AND HEAT EXCHANGE INCORPORATING SUCH HEAT TRANSFER PIPE

(75) Inventor: Shouichiro Usui, Numazu (JP)

(73) Assignee: Usui Kokusai Sangyo Kaisha, Ltd., Shizuoka (JP)

( * ) Notice: Subject to any disclaimer, the term of this patent is extended or adjusted under 35 U.S.C. 154(b) by 0 days.

(21) Appl. No.: 10/509,205

(22) PCT Filed: May 9, 2003

(86) PCT No.: PCT/JP03/05818

§ 371 (c)(1),
(2), (4) Date: Jan. 28, 2005

(87) PCT Pub. No.: WO03/095923

PCT Pub. Date: Nov. 20, 2003

(65) Prior Publication Data

US 2005/0145380 A1 Jul. 7, 2005

(30) Foreign Application Priority Data

May 10, 2002 (JP) ..... 2002-135740

(51) Int. Cl.
*F28F 1/40* (2006.01)

(52) U.S. Cl. ..... 165/177; 138/38; 138/177; 165/133

(58) Field of Classification Search ..... 165/133, 165/177, 179, 181; 138/37, 38, 115, 117, 138/DIG. 11
See application file for complete search history.

(56) References Cited

U.S. PATENT DOCUMENTS

| | | | | |
|---|---|---|---|---|
| 4,154,296 | A * | 5/1979 | Fijas | 165/179 |
| 4,937,064 | A * | 6/1990 | Gonzalez | 138/38 |
| 5,655,599 | A | 8/1997 | Kasprzyk | |
| 6,070,657 | A * | 6/2000 | Kunkel | 138/38 |
| 6,250,340 | B1 * | 6/2001 | Jones et al. | 138/177 |

FOREIGN PATENT DOCUMENTS

| | | |
|---|---|---|
| EP | 1 265 046 | 12/2002 |
| JP | 60-86781 | 6/1985 |
| JP | 11-108578 | 4/1999 |
| JP | 2000-18867 | 1/2000 |
| JP | 2001-227413 | 8/2001 |
| JP | 2002-028775 | 1/2002 |

* cited by examiner

*Primary Examiner*—Teresa J. Walberg
(74) *Attorney, Agent, or Firm*—Jordan and Hamburg LLP

(57) ABSTRACT

Soot adhering to the inner surface of a heat transfer pipe can be removed without lowering the heat transfer efficiency that is the inherent object of the heat transfer pipe or without stopping the cooling operation of the heat transfer pipe. Further, this soot removal can be effected when the amount of soot adhering to the inner surface of the heat transfer pipe is small, thus minimizing the soot-caused lowering in the heat transfer efficiency of the heat transfer pipe. A heat transfer pipe (1) wherein the inner peripheral surface of an element pipe (2) through which fluid can flow is formed with longitudinal grooves (4) as recessed grooves (3) of cross-section with a given depth such that the longitudinal grooves are parallel with the pipe axis and circumferentially continuous, and a partition wall (5) of given thickness is formed between the longitudinal grooves (4): and a heat exchanger incorporating this heat transfer pipe (1).

20 Claims, 11 Drawing Sheets

HEAT TRANSFER PIPE AND HEAT EXCHANGE INCORPORATING SUCH HEAT TRANSFER PIPE

BACKGROUND OF THE INVENTION

1. Field of the Invention

This invention relates to a heat conduction pipe and a heat exchanger assembled with said heat conduction pipes for performing thermal exchange between cooling water, cooling air, cooling medium for air conditioner, or other cooling mediums and EGR gas (Exhaust Gas Recirculation) gas or combustion exhaust gas including soot in a mulitube heat exchanger such as an EGR cooling mechanism and so on.

2. Description of Related Art

Conventionally, EGR systems in which a part of exhaust gas is taken out of an exhaust gas system and returned to an intake system of the engine to be added to the mixture gas and the intake air, have been used in engines for automobiles along with gasoline engines and diesel engines. With the EGR system, particularly with the cooled EGR system for diesel engines of high EGR rate, a cooling apparatus for cooling the EGR gas at a high temperature with cooling water, cooling air, refrigerants, or other cooling mediums is provided to reduce nitrogen oxide gas (NOx). in the exhaust gas, to prevent the mileage from becoming inferior, and to prevent functions and durability of the EGR valve from deteriorated due to excessively increased temperature.

As shown in FIG. 3, there is an EGR gas cooling apparatus that performs thermal exchange between the EGR gas and the cooling medium via heat conduction pipes by disposing a plurality of the heat conduction pipes having smaller diameters through the interior of which the EGR gas can communicate and by communicating flowing the cooling mediums such as cooling water, cooling air, refrigerants, etc., through the exterior of the heat conduction pipes.

As the heat conduction pipes like above, arts as described in Japanese Patent Application Publication Nos. JA-11-108,578, JA-2001-227,413, and JA-2002-28,775, and European Patent No. 1265,046 A2 have been known. With these conventionally known heat conduction pipes, the inner circumferential surface through which liquid can communicate is smooth, so that soot contained in the communicating exhaust gas may deposit thereon. Where the soot deposits on the inner surface of the heat conduction, the soot creates a heat insulation effect to reduce a thermal conduction efficiency, so that it is undesirable as diminishing functions in terms of the heat conduction pipe. Therefore, as a method to remove the soot from the inner surface of the heat conduction pipe, conventionally, adapted is to wipe the deposited soot with a member in a blush shape after use of the heat conduction pipe for a predetermined period, or to heat the heat conduction pipe to burn the soot by stopping a cooling operation therein.

However, with the method for wiping the soot off using the blush or the other, or for heating the heat conduction pipe to bum the soot by stopping a cooling operation therein, the workability of the heat conductor pipe may be significantly reduced, not only because many processing steps are needed but also because the cooling operation in the heat conductor pipe has to be stopped. With the aim of prevention of such defects so as to prevent the soot from depositing on the inner surface of the heat conductor pipe, practiced is to form a low energy coating such as fluoric resin on the inner surface of the heat conduction pipe. However, with the method for forming the low energy coating on the inner surface of the heat conduction pipe, the thermal conduction rate and the thermal conductivity of the low energy coating such as fluoric resin are low compared to metal, so that the thermal conduction efficiency of the heat conduction pipe as of essentially a heat exchanger may be reduced.

SUMMARY OF THE INVENTION

This invention is to solve the above problems. It is an object of the invention to provide a heat conduction pipe removing soot deposited thereon or preventing the soot deposition without reducing a thermal conduction efficiency as a primary object of the heat conduction pipe, neither stopping cooling operation in the heat conduction pipe. This invention also provides a heat conduction pipe minimizing reduction of the thermal conduction rate thereof for the soot and capable of forming the heat conduction pipe having large heat exchange surface by removing the soot while the soot deposits slightly on the inner surface of the heat conductive pipe, or by preventing the soot from depositing. Therefore, the thermal exchange between a liquid flowing through the interior of the heat conduction pipe and a liquid flowing through the exterior heat conduction pipe can be performed at the all times.

To solve the above problems, the first invention is for a heat conduction pipe comprising: a base pipe allowing a liquid to flow though an interior thereof; a plurality of axially extending grooves, formed parallel to a pipe axis in a row in a circumferential direction, having a cross section in a recess shape with a prescribed depth; and a plurality of dividing walls formed between the axially extending grooves adjacent to each other having a prescribed thickness.

The second invention is for a heat exchanger assembled with said heat conduction pipe comprising: the base pipe allowing the liquid to flow though the interior thereof; the plurality of axially extending grooves, formed parallel to the pipe axis in a row in the circumferential direction, having the cross section in the recess shape with the prescribed depth; and the plurality of dividing walls formed between the axially extending grooves adjacent to each other having a prescribed thickness.

The base pipe may be formed with a long plate-shaped fin member extending in a direction of the pipe axis, and wherein the plurality of the axially extending grooves having a cross section in a recess shape with a prescribed depth may be formed parallel to the pipe axis in a row on the surface of the plate-shaped fin member and the inner circumferential surface of the base pipe.

Distance P between the centers of the dividing walls next each other may be defined from 0.2 to 2.0 mm, and depth H from the top of the dividing wall may be defined from 0.5 P to 1.0 P mm.

A bottom portion of the axially extending groove, formed in a flat shape may be connected to the dividing wall via a corner portion.

The bottom portion of the axially extending groove, formed in a flat shape may be connected to the dividing wall via arch portion.

The bottom portion of the axially extending grooves and the dividing wall may be formed running in a circular shape.

One end of the plate-shaped fin member may be connected to the inner circumferential surface of the base pipe and the other end thereof may be protruded in the base pipe so as not to contact with the inner surface circumferential surface of the based pipe.

The plate-shaped fin members may be formed to divide an inner space of the base pipe into a plural number.

The plate-shaped fin member may be formed by folding a plate member provided separately from the base pipe to form a connecting surface thereof being brazed or welded to the inner circumferential surface of the base pipe corresponding to the inner circumferential surface of the base pipe.

The plate-shaped fin member and the base pipe may be formed in a united body in forming base pipe.

As described above, the heat exchanger of this invention is formed by the base pipe allowing the liquid to flow through the interior thereof; axially extending grooves formed parallel to the pipe axis in a row in the circumferential direction having the cross section in the recess shape with the prescribed depth; and the dividing wall formed between the axially extending grooves adjacent to each other having the prescribed thickness. According to an experiment, it is confirmed that with the heat conductive pipe structured as described above, the soot does not deposit on the inner surface thereof. However, theoretical reason why the soot does not deposit on the inner surface of the heat conductive pipe is vague. As reasons why the soot is not deposed on the inner surface of the heat conductive pipe, the following two reasons are presumed.

As the first reason, a speed of a liquid flowing through the interior of the heat conductive pipe is different between the tops of the dividing walls and the bottom portions of the recesses, so that the speed difference causes a burst phenomenon that a flowing liquid through the boundary is led with a main flow flowing through the center portion of the heat conductive pipe. Therefore, the soot deposited on the inner surface of the axially extending grooves is exfoliated as the flowing liquid through the boundary is led with the main flow, thereby being able to flow into the main flow. Furthermore, the phenomenon that the flowing liquid though the boundary is led with the main flow arises inside the heat conductive pipe at the all times, so it is supposed that impurities such as soot contained in the flowing liquid is hardly subject to attaching to the inner surface of the heat conductive pipe to be capable of preventing a thermal conduction rate from deteriorated due to the deposited soot at the all times.

As the second reason, it is supposed that exhaust gas containing particles of the soot cannot enter the inner portions of the axially extending grooves formed on the inner surface of the heat conductive pipe due to high flowing resistance, so that the soot does not deposit on the inner surface of the heat conductive pipe as the result. Also, it is thinkable that the first reason and the second reason operate multiplicatively.

According to an experiment, it is confirmed that in the axially extending grooves formed on the heat conductive pipe, defining distance P between the centers of the dividing walls next to each other from 0.2 to 2.0 mm and depth H from the top of the dividing wall from 0.5 P to 1.0 P mm makes a separating effect of said soot the best. Where distance P between the centers of the dividing walls next to each other is defined shorter than 0.2 mm, it is supposed that the recesses are not formed accurately, and the burst phenomenon occurs less frequently, so that the separating effect of the soot caused by the flowing liquid though the boundary led with the main flow decreases, or exhaust gas containing particles of the soot reaches into the inner portions of the axially extending grooves due to low flowing resistance. Also, where distance P between the centers of the dividing walls next to each other is defined longer than 2.0 mm, the burst phenomenon does not occur many times, nor does a preventive effect of influx of exhaust gas containing particles of the soot change, so that the separating effect does not increase, thereby undesirably increasing the pressure loss. In addition, where distance P is defined longer than 2.0 mm, the manufacture thereof is so difficult that the heat conduction pipe becomes expensive.

Where depth H from the top of the dividing wall is defined shorter than 0.5 P mm, it is supposed that the recesses are not formed accurately, the burst phenomenon occurs less frequently, so that the separating effect of the soot caused by the flowing liquid though the boundary led with the main flow decreases, or exhaust gas containing particles of the soot is easy to enter the inner portions of the axially extending grooves due to low flowing resistance. Also, where depth H from the top of the dividing wall is defined longer than 1.0 P mm, the burst phenomenon does not occur many times, nor does the preventive effect of influx of exhaust gas containing particles of the soot change. Furthermore, where depth H from the top of the dividing wall is defined longer than 1.0 P mm, pressure loss increases, so it is undesirable.

A long plate-shaped fin member extending in a direction of the pipe axis is formed in the base pipe, and wherein the plurality of axially extending grooves having a cross section in a recess shape with a prescribed depth are formed parallel to the pipe axis in a row on the surface of the plate-shaped fin member and the inner circumferential surface of the base pipe, so that a conductive surface can be enlarged greatly, thereby being able to improve the thermal exchange efficiency of the heat conductive pipe. Heat from the liquid flowing thorough the interior of the heat conductive pipe is conducted not only to the base pipe where the surface thereof has been enlarged but also to the long plate-shaped fin member, and furthermore, heat conducted to the long plate-shaped fin member is efficiently conducted to the base pipe, so that a mutually thermal exchange efficiency between the flowing liquid through the interior of the heat conductive pipe and the flowing liquid through the exterior thereof can be improved. Furthermore, the reduction of the thermal conductive efficiency due to the soot is prevented by forming the axially extending grooves on the base pipe and the long plate-shaped fin member, so that the efficient thermal exchange of the base pipe can last.

Also, in the axially extending grooves to be formed on the long plate-shaped fin member, it is preferable to define distance P between the centers of the dividing walls next to each other from 0.2 to 2.0 mm and depth H from the top of the dividing wall from 0.5 P to 1.0 P mm so as to be able to make the separating effect of the soot the best.

The axially extending grooves to be formed on the circumferential surface of the base pipe and on the surface of the plate-shaped fin member may be in an any shape, whereas the bottom portion of the axially extending groove, for instance, may be formed in a flat shape and connected to the dividing wall via a corner portion. In the axially extending grooves having the corner portions like above where both the bottom portions and the wall portions are straight, technique for manufacture is so easy that the heat conductive pipe can be manufactured at low cost.

The bottom portions of the axially extending grooves may be formed in the flat shape and connected to the dividing walls via arch portions, whereas the burst phenomenon that the flowing liquid trough the boundary is led with the main flow arises easily due to existence of the arch portions, so that it is difficult for exhaust gas containing particles of the soot to enter the inner portions of the axially extending grooves.

Where the bottom portions of the axially extending grooves and the dividing walls thereof are circularly formed in a row, the burst phenomenon occurs the most frequently and the separating effect of the soot is superior, and exhaust gas containing particles of the soot is hardly subject to entering the inner portions of the axially extending grooves due to high flowing resistance in that event. Where the axially extending portion is formed in a circular shape, it is preferable to define radius R of the circle from 0.5 P to 1.0 P mm toward distance P between the center of the dividing wall and the center of the next dividing wall. Where radius R is defined shorter than 0.5 P mm, the burst phenomenon occurs less frequently so low that the separating effect of the soot decreases or exhaust gas containing particles of the soot reaches into the bottom portion of the axially extending groove due to low flowing resistance. Where radius R is defined longer than 1.0 P mm, it is supposed that the burst phenomenon does not occur many times, nor does the preventive effect of influx of exhaust gas containing particles of the soot change, so the manufacture of the heat conductive pipe is so difficult that it becomes expensive in the event of defining radius R longer than 1.0 P mm.

One end of the plate-shaped fin member may be connected to the inner surface of the base pipe and the other end thereof may be protruded in the base pipe so as not to contact with the inner surface circumferential surface of the base pipe. The protruded plate-shaped fin member causes a turbulent flow into the flowing liquid through the interior of the heat conductive pipe, thereby advancing the thermal exchange between the flowing liquid through the interior thereof and the flowing liquid through the exterior thereof via the heat conductive pipe due to the dispersed boundary. Also, the separation of the soot deposited on the inner surface of the heat conductive pipe is advanced because of changing the flowing liquid into the turbulent flow, thereby being able to prevent the thermal conductivity from decreasing.

The plate-shaped fin members may be formed to divide the inner space of the base pipe into a plural number. In that event, the flowing liquid can be prevented from flowing partially, thereby flowing dispersively through the interior of the heat conductive pipe and increasing pressure of contacted surface, so that capability for the thermal exchange can be improved by conducting heat from the liquid efficiently to the heat conductive pipe.

The plate-shaped fin member and the base pipe are formed together at the same time, in that event, there is no resistance in the thermal current from the plate-shaped fin member to the base pipe, and the process for connecting the base pipe and the plate-shaped fin member can be saved.

The plate-shaped fin member may be composed of a plate member individually from the base pipe, and both the plate member and the base pipe may be connected in the later process, whereas for instance, the connecting surface of the plate-shaped fin member, corresponding to the inner circumferential surface of the base pipe, is formed by folding the plate member, and brazed or welded to the inner circumferential surface of the base pipe, thereby connecting the base pipe and the plate-shaped fin member. With the plate-shaped fin member formed like above, a forming like, thereby being able to improve usability and durability of the heat conductive pipe.

The above-described heat conductive pipe can be used in any apparatus where perform the thermal exchange such as engines for automobiles, other internal combustion engines, air conditioners, and so on. Where the heat conductive pipe in this invention is coupled to the multitube heat exchanger such as an EGR cooling mechanism and so on, EGR gas can be cooled down efficiently. Therefore, with the EGR system, particularly with the cooled EGR system for diesel engines of high EGR rate, nitrogen oxide gas (NOx) in the exhaust gas can be reduced, and the mileage can be prevented from becoming inferior. Furthermore, the EGR valve and functions thereof can be prevented from deteriorated by preventing temperature from increasing excessively.

In the base pipe used in this invention, wherein a cross section perpendicular to the pipe axis thereof may be in an any shape such as a circle, ellipse, rectangle, flattened shape, square, or the like. The heat conductive pipe may be composed by forming the plate-shaped fin member in the base pipe so as to unite, wherein both the plate-shaped fin member and the base pipe are made of metal such as copper, aluminum, brass, stainless steel or the like. Also, the heat conductive pipe may be composed by forming the plate-shaped fin member made of one of the above-described kinds of metal in the metallic base pipe.

BEST MODE FOR CARRYING OUT THE INVENTION

Figure 1:
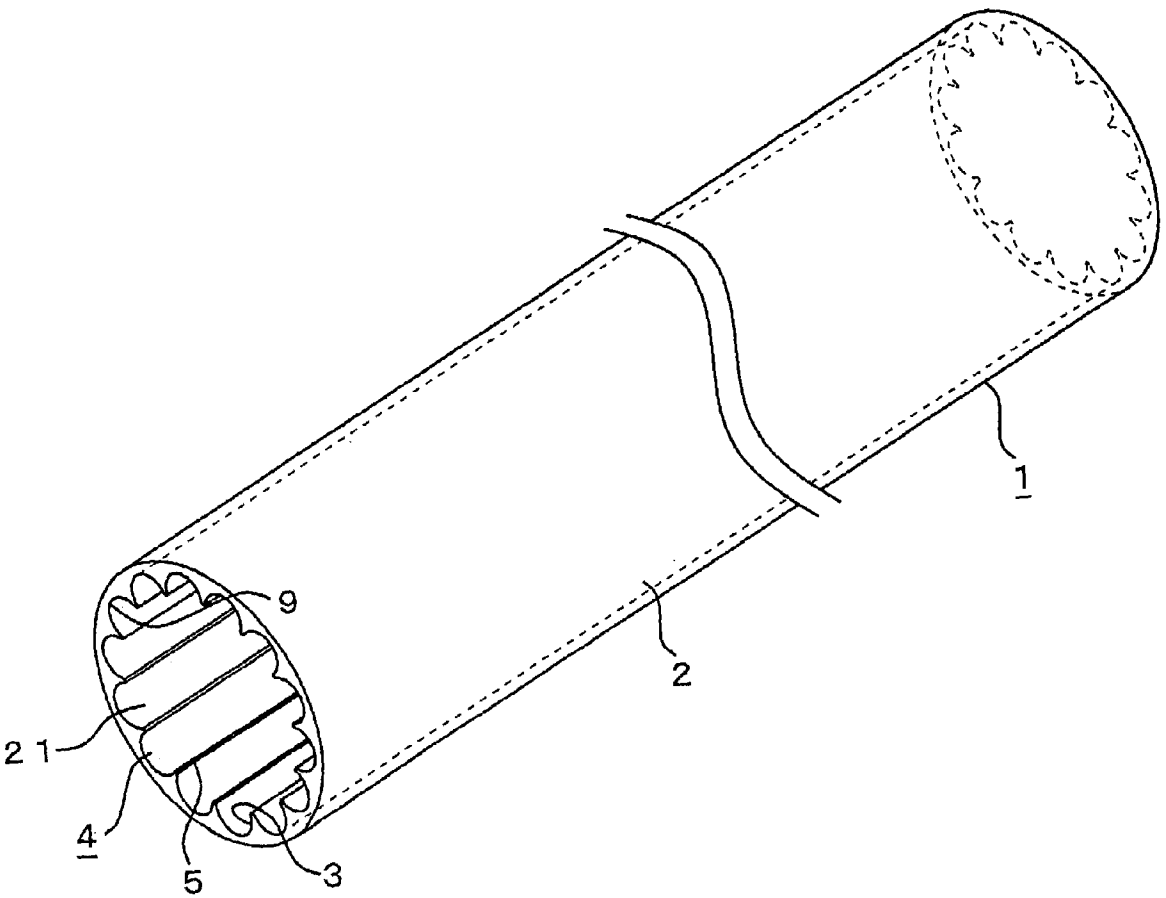
FIG. 1 is a perspective view of the heat conductive pipe composed by the base pipe having the plurality of the axially extending grooves in the circular recess shape on the inner circumferential surface thereof according to the first embodiment of the invention.

Hereinafter, according to a heat conductive pipe of this invention, the first embodiment in which the heat conductive pipe an EGR gas cooling apparatus is used in a cooled EGR system for automobiles is described in reference to FIG. 1, FIG. 2, and FIG. 3. Numeral 1 is the heat conductive pipe wherein axially extending grooves having a cross section perpendicular to a direction of the pipe axis defined recesses 3 in a shape with a prescribed depth on an inner circumferential surface of a base pipe 2.

The axially extending grooves 4 are formed parallel to a pipe axis in a row in a circumferential direction of the heat conductive pipe 1. The axially extending grooves 4 in a row form dividing walls 5 with a prescribed thickness dividing between themselves. According to the first embodiment, bottom portions 9 of the axially extending groove 4 and the dividing wall 5 are formed running in a circular shape, thereby forming a cross section of the recess 3 in a substantially semicircle shape.

Figure 2:
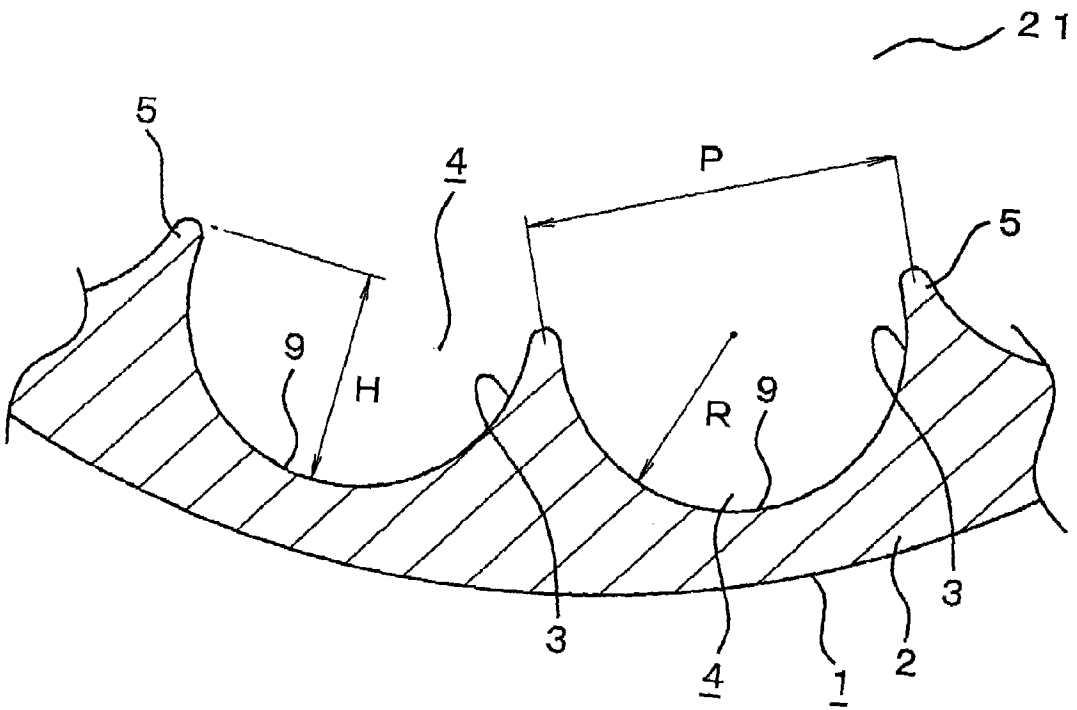
FIG. 2 is an enlarged cross-sectional view of the axially extending groove portion formed on the inner circumferential surface of the base pipe.

The axially extending grooves 4 formed on the heat conductive pipe 1 are formed so that distance P between the centers of the dividing walls 5 next to each other is defined from 0.2 to 2.0 mm, and depth H from the top of the dividing wall 5 is defined from 0.5 P to 1.0 P mm, as shown in FIG. 2, and further, it is confirmed that a separating effect of said soot or a preventive effect of influx if exhaust gas containing particles of the soot is made the best according to an experiment at that event. Formative radius R of the recess 3 in a circular shape is defined from 0.5 P to 1.0 P mm.

Figure 3:
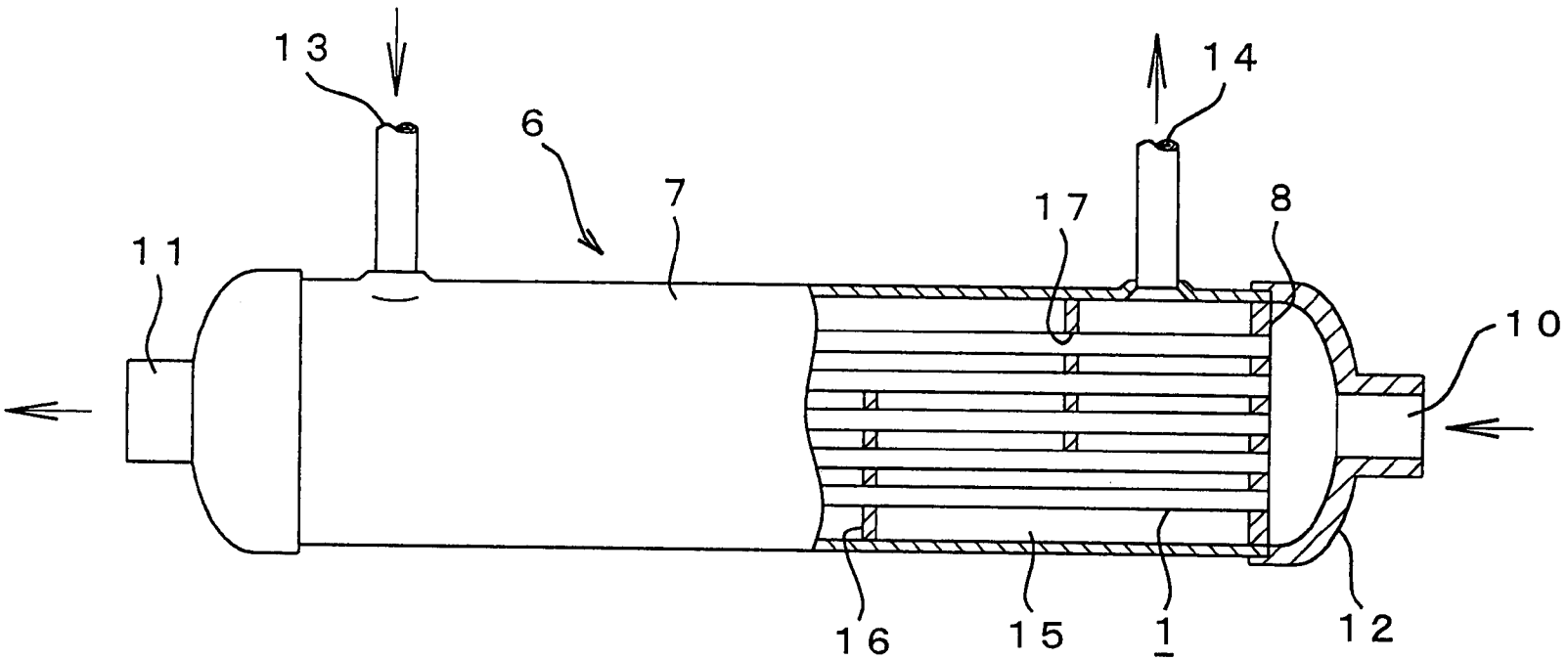
FIG. 3 is a partially opened plan view of the EGR cooling mechanism provided with the plurality of the conductive pipes in this invention.

FIG. 3 shows an EGR cooling apparatus 6 provided with the heat conductive pipes 1 like above. With the EGR gas cooling apparatus 6, each of tube sheets 8 is coupled around each end of a cylindrical body pipe 7 so as to be capable of sealing the interior. The plural the heat conductive pipes 1 according to the first embodiment are disposed in a connecting manner between the pair of the tube sheets 8 as penetrating though the tube sheets 8. Coupling members 12, formed with either of an inlet 10 and an outlet 11 of the EGR gas, are coupled to opposite ends of the body pipe 7.

The inflow 13 and the outflow 14 for cooling mediums such as cooling water for engines, cooling air, cooling medium for air conditioner, or the like are formed on an outer circumference of the body pipe 7, whereas a sealed space partitioned with a pair of tube sheets is defined as a cooling portion 15 allowing cooling mediums to flow the interior thereof. It is preferable that the heat conductive pipe is formed with the plural the supporting plates 16 provided inside in a coupling manner, and the heat conductive pipes 1 are inserted in the inserting holes 17 of the supporting plates 16 to support the heat conductive pipes 1 stably as baffle plates, to render meandered the flow of the cooling medium flowing the interior of the cooling portion 15.

In the EGR gas cooling apparatus 6 thus structured, where heated EGR gas is introduced from the inlet 10 into the body base 7, the EGR gas flows into the plurality of the heat conductive pipes 1 coupled to the interior of body pipe 7. In the cooling portion 15 assembled with the heat conductive pipes 1, cooling medium such as cooling water for engines or the like flows outside the heat conductive pipes 1, thereby being capable of performing the thermal exchange between EGR gas and the cooling medium though the exterior and the interior surface of the heat conductive pipes 1.

In the above-described thermal exchange, in a case where a flowing liquid through the interior of the heat conductive pipe 1 contains soot or the like inside thereof like exhaust gas from diesel engines, the soot attaches to and deposit on the inner circumferential surface of the heat conductive pipes 1. However, the supposable first reason why the soot does not deposit on the interior of the heat conductive pipe 1 in the embodiments of the invention, is that flowing resistance of the liquid flowing through the interior of the heat conductive pipe 1 is different between the tops of the dividing wall 5 and the bottom portions 9 of recesses 3, so that the speed of the flowing liquid is different each other. The speed difference causes a burst phenomenon that the flowing liquid through the boundary is led with the main flow flowing through the center of the heat conductive pipe 1, so that the soot deposited on the surface of the axially extending grooves 4 can be exfoliated and flowed into the main flow as the flowing liquid through the boundary is led with the main flow.

As the second reason why the soot does not deposit on the interior of the heat conductive pipe 1, it is supposed that exhaust gas containing particles of the soot cannot enter the inner portions of the axially extending grooves 4 formed on the inner surface of the heat conductive pipe 1 due to high flowing resistance, so that the soot does not deposit on the inner surface of the heat conductive pipe 1 as the result. Also, it is thinkable that the first reason and the second reason operate multiplicatively.

Furthermore, the phenomenon that the flowing liquid through the boundary is led with the main flow or the preventive effect of influx of exhaust gas containing particles of the soot arise inside the heat conductive pipe 1 at the all times, so it is supposed that impurities such as the soot contained in the flowing liquid becomes to be hardly subject to attaching to the inner surface of the heat conductive pipe 1, thereby being capable of preventing a thermal conduction rate from deteriorated due to the deposited soot at the all times.

Figure 4:
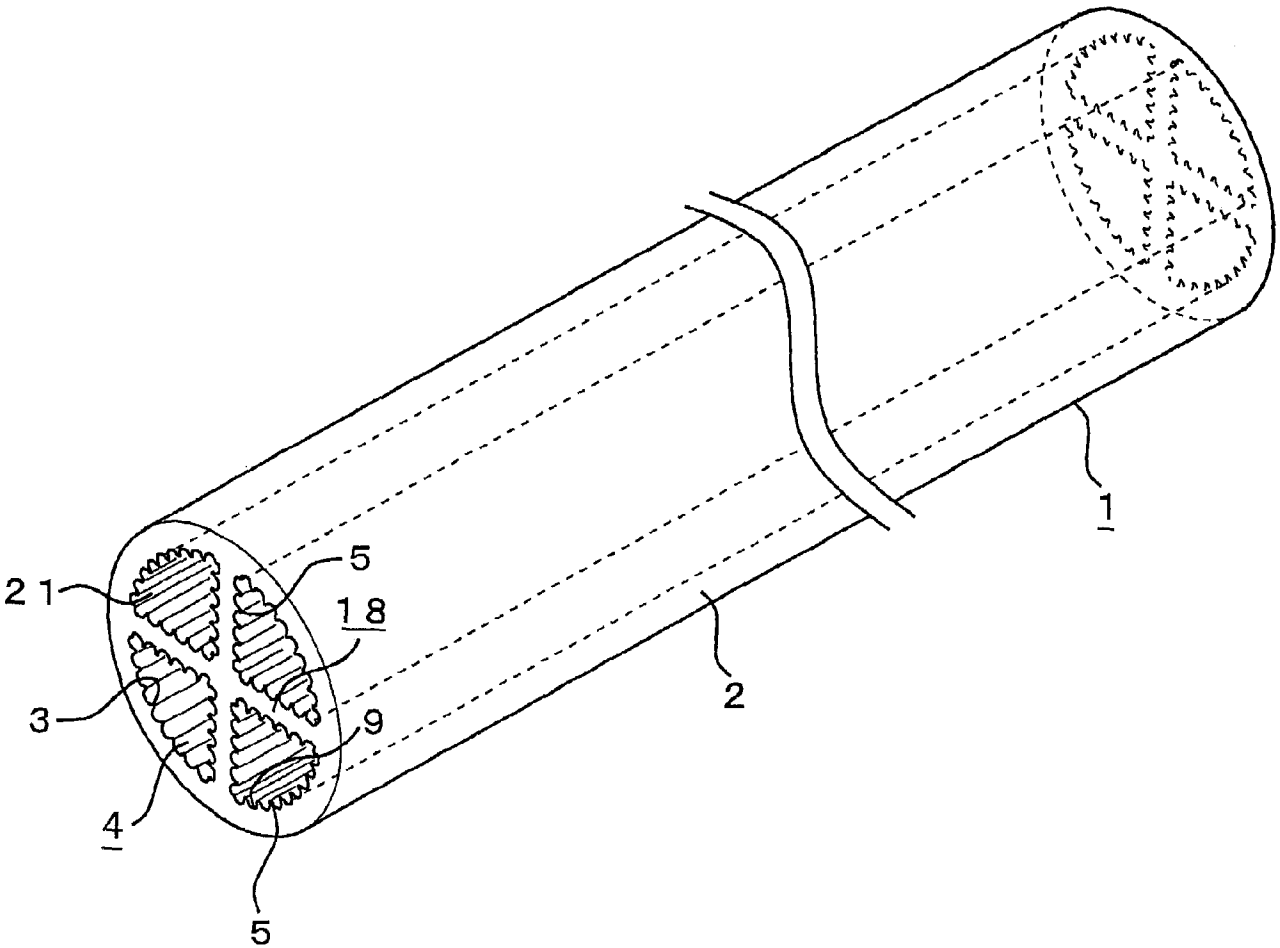
FIG. 4 a perspective view of the heat conductive pipe composed by forming the long plate-shaped fin member, extending in a direction of the pipe axis, having an end section in a cross section, in the base pipe according to the second embodiment of the invention.

In the first embodiment as described above, none of the fin members are not formed inside the base pipe 2, but in the second embodiment to the fifth embodiment as described hereinafter, the plate-shaped fin member 18 is formed inside the base pipe 2 to enlarge heat transfer area, thereby aiming at improving capability for the thermal exchange. First, in the second embodiment, as shown in FIG. 4, the long plate-shaped fin member 18 having an end section in a cross shape extending in the direction of the pipe axis is formed on the inner circumferential surface of the base pipe 2 to enlarge the heat transfer area of the base pipe 1. The plate-shaped fin member 18 and the base pipe 2 are formed in the united body in forming the base pipe 2 so as to divide an inner space 21 of the heat conductive pipe 1 into four spaces in a radial pattern.

Figure 5:
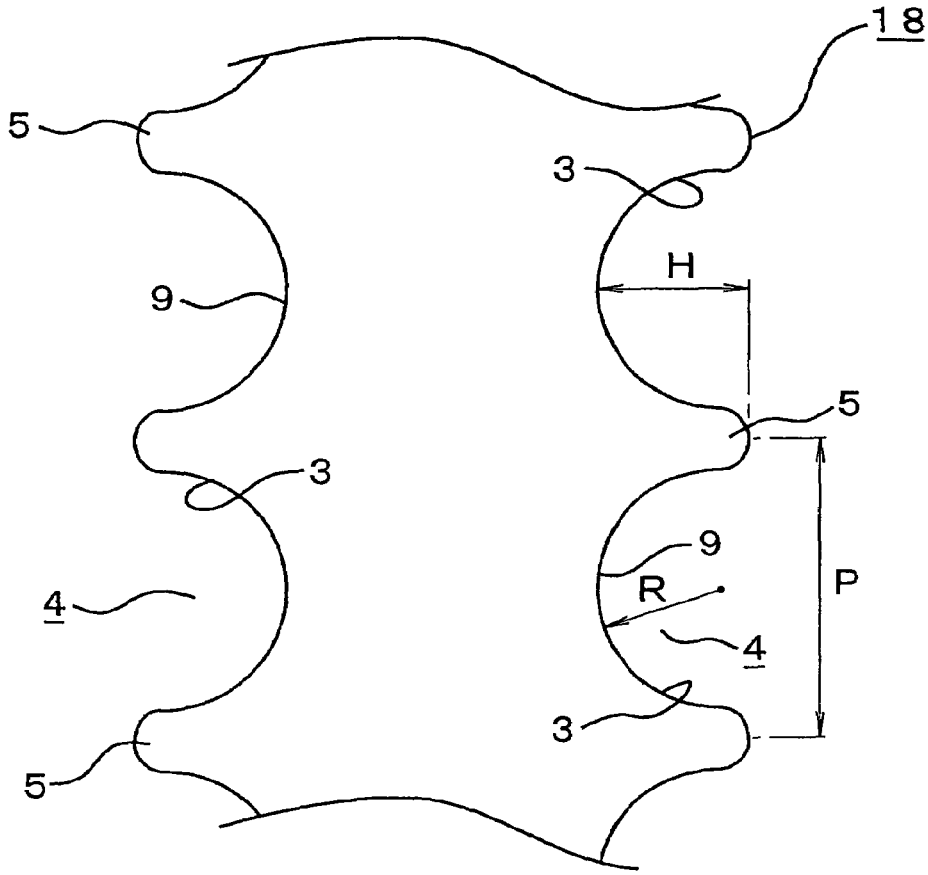
FIG. 5 is an enlarged cross-sectional view of the axially extending grooves portion formed on the surface of the plate-shaped fin member.

Furthermore, in the second embodiment, as shown in FIG. 4 and FIG. 5, the plurality of the axially extending grooves 4 having a cross section in a recess 3 shape perpendicular to the direction of the pipe axis with the prescribed depth are formed parallel to the pipe axis in a row not only on the inner circumferential surface of the base pipe 2 but also on each of the surfaces of the plate-shaped fin member 18. Furthermore, a dividing wall 5 having a prescribed thickness partitioning the axially extending grooves 4 adjacent to each other in a row is formed thereon.

As shown FIG. 2 and FIG. 5, in the axially extending grooves 4 formed on the inner circumferential surface of said base pipe 2 and on each of the surfaces of the plate-shaped fin member 18, distance P between the centers of the dividing walls 5 next to each other is defined from 0.2 to 2.0 mm, and distance H from the top of the dividing wall 5 is defined from 0.5 P to 1.0 P mm. Furthermore, radius R of the recess 3 in circular shape is formed with a range thereof from 0.5 P to 1.0 P mm. In the heat conductive pipe 1 assembled with said axially extending grooves 4 and the plate-shaped fin member 18 according to the second embodiment, it is supposed that the separating effect of the soot or the preventive effect of influx of exhaust gas containing particles of the soot as described above are made the best, and according to an experiment, it is confirmed that the preventive effect of the soot attachment arises.

In the heat conductive pipe 1 according to the second embodiment as described above, the plate-shaped fin, member 18 is formed inside said heat conductive pipe 1, and the plurality of the axially extending grooves 4 are formed both on the each: of the surfaces of said plate-shaped fin member 18 and on the inner circumferential surface of the base pipe 2, thus allowing the heat transfer area to be enlarged. Furthermore, the base pipe 2 and the plate-shaped fin member 18 are formed in the united body, so that there is no resistance in the thermal current from the plate-shaped fin member 18 to the base pipe 2, thereby increasing each thermal conductivity. Therefore, heat from exhaust gas is conducted to the plate-shaped fin member 18, thus allowing heat from said plate-shaped fin member 18 to be conducted to the surface of the base pipe 2 efficiently. In addition, the plate-shaped fin member 18 divides the inner space 21 into four spaces, thereby being capable of preventing flow of flowing EGR gas from flowing partially to enable EGR gas flow dispersively through the inner space 21 divided into four spaces and to enlarge contacted surface between EGR gas and the inner circumferential surface of the heat conductive pipe 1. Accordingly, the thermal exchange between EGR gas and cooling mediums via the heat conductive pipe 1 can be performed efficiently.

Also, in the second embodiment, the impurity such as soot contained in the flowing liquid becomes to be hardly subject to attaching to the inner surface of the heat conductive pipe 1 by forming the plurality of the axially extending grooves 4 on each of surfaces of the plate-shaped fin member 18 and on the inner circumferential surface of the base pipe 2, thereby being capable of preventing thermal exchange efficiency from deteriorated at the all times. Therefore, the efficient thermal exchange can be performed at the all times by maintaining the thermal conductivity improved due to forming the plate-shaped fin member 18.

Figure 6:
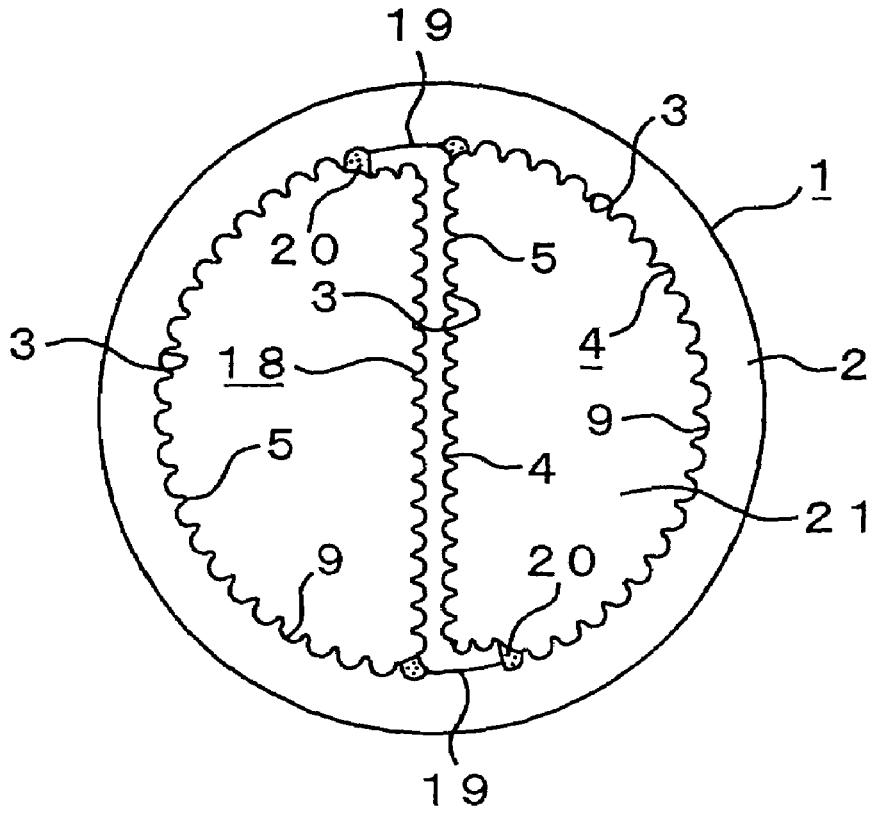
FIG. 6 is an end view of the heat conductive pipe provided with the plate-shaped fin member having an end section in a substantially letter-I shape according to the third embodiment.

Next, the heat conductive pipe 1 according to the third embodiment will be explained referring to FIG. 6. The heat conductive pipe 1 according to the second embodiment as described above is formed by forming the plate-shaped fin member 18 having the end section in the cross shape and the base pipe 1 to be in a united shape. On the other hand, in the third embodiment, the plate-shaped fin member 18 having the end section in a substantially letter-I shape is formed separately from the base pipe 2, and the plate-shaped fin member 18 is fixed on the inner circumferential surface of said base pipe 2 in a connecting manner by means of brazing to divide the inner space 21 into two spaces as shown in FIG. 6. The plate-shaped fin member 18 is formed by bending each of long lateral sides of the plate-shaped fin member 18 in opposite direction to each other to form a pair of connecting surfaces 19 in a substantially circular shape corresponding to the inner circumferential surface of the base pipe 2 due to brazing. By sticking and brazing the pair of the connecting surfaces 19 to the inner circumferential surface of the base pipe 2, whereas the base pipe 2 and the plate-shaped fin member 18 are fixed in connecting manner with fillets 20 made from wax, and the thermal conduction between the base pipe 2 and the plate-shaped fin member. 18 is performed via said fillets 20 as well as the connecting surfaces 19, thereby being capable of enlarging the heat transfer area and improving the thermal conduction.

Also, in the third embodiment, though the plurality of the axially-extending grooves 4 having the cross section in the circularly recess 3 shape with the prescribed thickness are formed in a row on the inner circumferential surface, of the base pipe 2 and each of the surfaces of the plate-shaped fin member 18, the connecting surfaces 19 of the plate-shaped fin member 18 and the portions to be connected to the connecting surfaces 19 of the inner circumferential surface of the base pipe 2 are formed without forming the axially extending grooves 4, thereby enlarging the contacted area to allow the thermal conductivity between the base pipe 2 and the plate-shaped fin member 18 to be performed well.

However, the axially extending grooves 4 may be formed on the connecting surfaces 19 of the plate-shaped fin members 18 and on the inner circumferential surface of the base pipe 2 all over, thereby arising gaps between the connecting surfaces 19 and the inner circumferential surface of the base pipe 2 due to the axially extending grooves 4 of each other in that event, but the gaps are closed with the fillets 20 by pouring wax, thereby being capable to enlarging each contact area, thus allowing the thermal conductivity to be improved.

The plate-shaped fin member 18 is formed separately from the base pipe 2 as described above, so the axially extending grooves 4 or the dividing walls 5 are easy to be formed on the base pipe 2 and the plate-shaped fin member 18 though there is a process for brazing the both. Furthermore, the base pipe 2 is connected to the plate-shaped fin member 18 with large contacted area not only via the connecting surfaces 19 but also via the fillets 20, thereby improving the thermal conductivity between the base pipe 2 and the plate-shaped fin member 18, thus allowing the thermal exchange efficiency between EGR gas flowing through the interior of the heat conductive pipe 1 and the cooling mediums flowing through the exterior thereof to be improved.

The connecting surfaces 19 may be connected and fixed to the inner circumferential surface of the base pipe 2 by means of weld. The gaps can be closed with welded metal, and the thermal conduction between the plate-shaped fin member 18 and the base pipe 2 are performed via connecting surfaces 19 and a portion as large as thickness of the welded metal, so that the heat conductive pipe 1 with the great thermal exchange efficiency is available.

Figure 7:
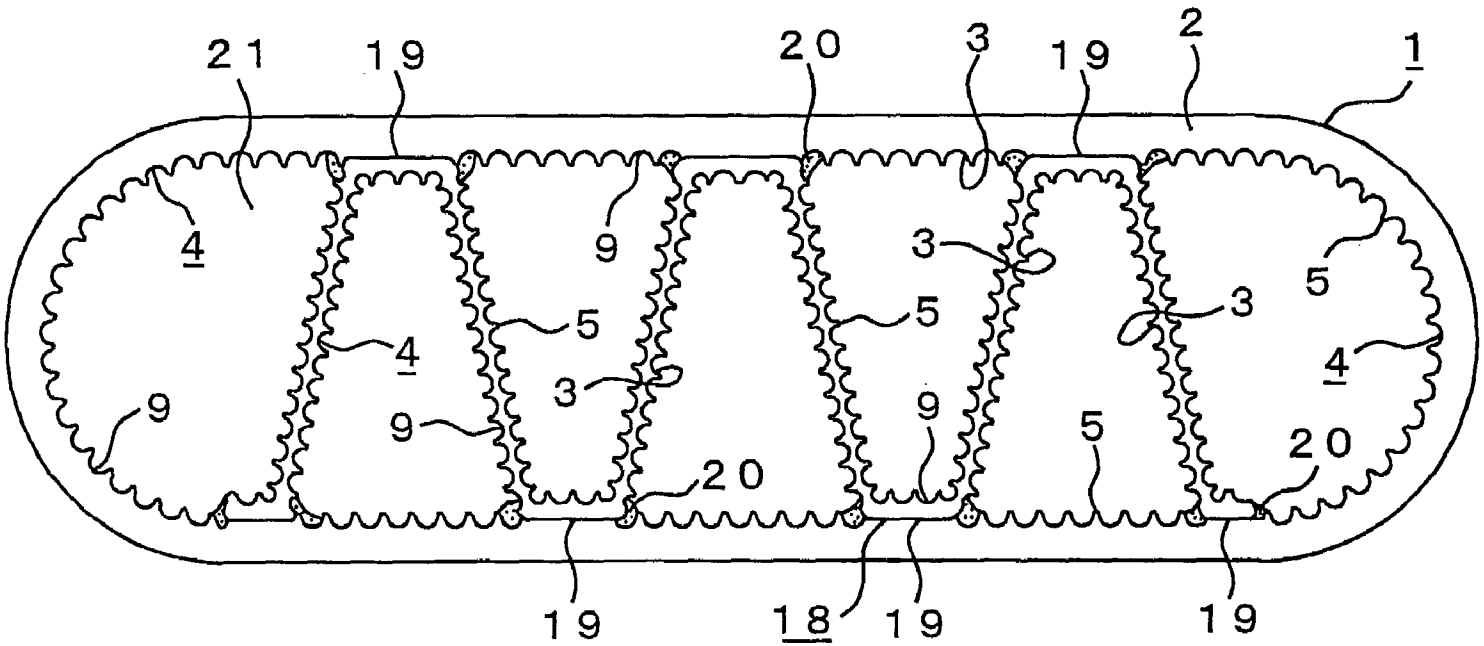
FIG. 7 is an end view of the heat conductive pipe composed by forming the plate-shaped fin member having uneven surface in the base pipe having an end section in flat shape so as to divide the inner space of the base pipe into the plural number according to the forth embodiment of the invention.

Also, in the fourth embodiment wherein the base pipe 2 and the plate-shaped fin member 18 are formed separately form each other, as shown in FIG. 7, the plate member 18 is bent back several times parallel to the pipe axis inside the base pipe 2 having an end section in a flat shape, thereby forming the plate-shaped fin member 18 dividing the inner space 21 of the base pipe 2 into a plural number. Furthermore, to the longer sides facing opposite side each other of the inner circumferential surface of the base pipe 2, the connecting surfaces 19 parallel to said sides of the inner circumferential surface are brazed, whereas the base pipe 2 is connected and fixed to the plate-shaped fin member 18 via the fillets 20.

The inner space 21 of the base pipe 2 is divided into the plural number in transverse direction by this plate-shaped fin member 18, thereby being capable of preventing well EGR gas from flowing partially despite the base pipe 2 in the flat shape. There has been the heat conductive pipe 1 wherein the plate-shaped fin member 18 having unevenness inside the base pipe 2 in the flat shape as described above as disclosed in European Patent No. 1265,046 A2 and Japanese Patent Application Publication No. 2002-28,775. However, in this invention, the plurality of axially extending grooves 4 are formed on the plate-shaped fin member 18, thus allowing heat transfer area to be enlarged. Furthermore, the contacted area between the plate-shaped fin member 18 and the base pipe 2 is so much to improve the thermal conductivity from EGR gas to the plate-shaped fin member 18 and further, from the plate-shaped fin member 18 to the base pipe 2, thereby being capable of improving the thermal exchange efficiency between EGR gas and cooling mediums via the heat conductive pipe 1 compared to conventional arts. Furthermore, the axially extending grooves 4 are formed on the plate-shaped fin member 18, thereby being capable of improving the preventive effect the soot attachment to the inner surface of the base pipe 1 and the separating effect of the soot.

Figure 8:
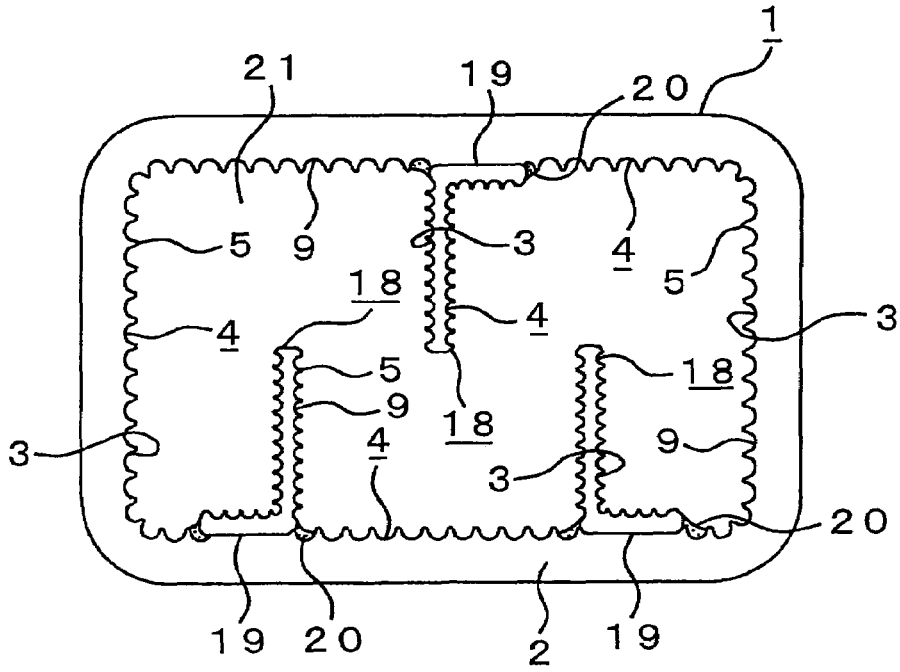
FIG. 8 is an end view of the heat conductive pipe composed by forming the plurality of the plate-shaped fin members having an end section in a substantially letter-L in the base pipe according to the fifth embodiment of the invention.

In the second embodiment to the fourth embodiment as described above, the inner space 21 of the base pipe 2 is divided into the plural number by the plate-shaped fin member 18. On the other hand, in other different embodiment, the fifth embodiment as shown in FIG. 8, one end of each of the plural plate-shaped fin members 18 is connected to the inner circumferential surface of the base pipe 2, but the other end thereof is protruded in the base pipe 2 so as not to contact with the inner circumferential surface of the base pipe 2, so that the inner space 21 is formed without being divided. A connecting surface 19 is formed on one end of said plate-shaped fin member 18 by bending a long plate member to be an end section thereof in a substantially letter-L shape. The connecting surfaces 19 of plate-shaped fin members 18 are alternately brazed or welded to each side facing opposite side each other of the inner circumferential surface of the base pipe 2 having an end section in a substantially square shape. Furthermore, in this embodiment, the plurality of the axially extending grooves 4 having the cross section in the circular recess 3 shape with the prescribed thickness are formed in a row on the inner surface of the base pipe 2 and each of the surfaces of the plate-shaped fin member 18.

The plate-shaped fin member 18 is formed inside the base pipe 2 without dividing the inner space 21 as described above, thereby enlarging heat transfer area of the heat conductive pipe 1 and causing a turbulent flow into EGR gas flowing through the interior thereof, so that the thermal exchange between EGR gas and cooling mediums via the heat conductive pipe 1 is promoted due to a dispersed boundary. The axially extending grooves 4 are formed on the inner circumferential surface of the base pipe 2 or on each of the surfaces of the plate-shaped fin member 18, so that the soot attachment to the inner surface of the base pipe 1 is hardly caused, and separation of the soot attaching to the inner surface of the heat conductive pipe 1 is promoted because the plate-shaped fin member 18 changes. EGR gas into the turbulent flow, thereby being capable of preventing the thermal exchange efficiency from deteriorated due to the soot attachment at the all times.

In the forth embodiment and fifth embodiment as described above, the connecting surface 19 of the plate-shaped fin member 18 and the contacted portion the inner circumferential surface of the base pipe 2 correspondent to said connecting surface 19 may be formed without forming the axially extending grooves 4 to enlarge the contacted area of each other, or may be formed with forming the axially extending grooves 4 and the gaps between each of the contacted surfaces to be closed with the wax or the fillet 20 made from metal, thereby being capable of improving the thermal conductivity between the plate-shaped fin member 18 and the base pipe 2.

Figure 9:
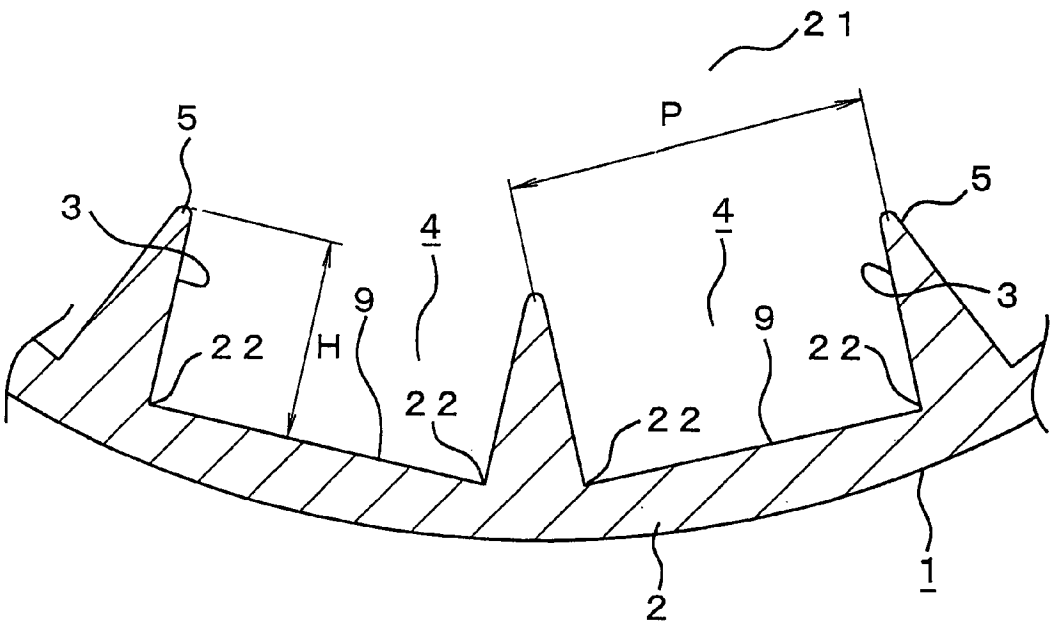
FIG. 9 is an enlarged cross-sectional view of the axially extending groove portion according to the sixth embodiment of the invention.

In the first embodiment to the fifth embodiment as described above, the axially extending groove 4 to be formed the inner circumferential surface of the base pipe 2 and on each of the surfaces of the plate-shaped fin member 18 is in a shape that the bottom portion 9 of the recess 3 and the wall portion of the dividing wall 5 are formed running in a circular shape, but the axially extending grooves 4 may be formed in an any other shape. In the sixth embodiment as shown in FIG. 9, the bottom portions 9 of the axially extending grooves 4 are formed in a flat shape and the wall portions of the dividing walls 5 are also formed in a flat shape, thereby connecting said dividing walls 5 and said bottom portions 9 via substantially right angled corners 22 to form the recesses 3. In that case, as shown in FIG. 9, it is also preferable that distance P between the centers of the dividing walls 5 next to each other is defined from 0.2 to 2.0 mm and depth H from the top of the dividing wall 5 is defined from 0.5 P to 1.0 P mm, thereby being capable of making the separating effect of the soot the best.

With the axially extending grooves 4 wherein the bottom portions 9 and the wall portions of the dividing walls 5 are in the flat shape with forming the corners 22 as described above, art for the manufacture is easy compared to the axially extending grooves 4 in the circular shape. Furthermore, in a case where the axially extending grooves 4 are formed in the above-described shape, the separating effect of the soot attached to the surface of the axially extending grooves 4 is improved for the occurrence of the burst phenomenon.

Figure 10:
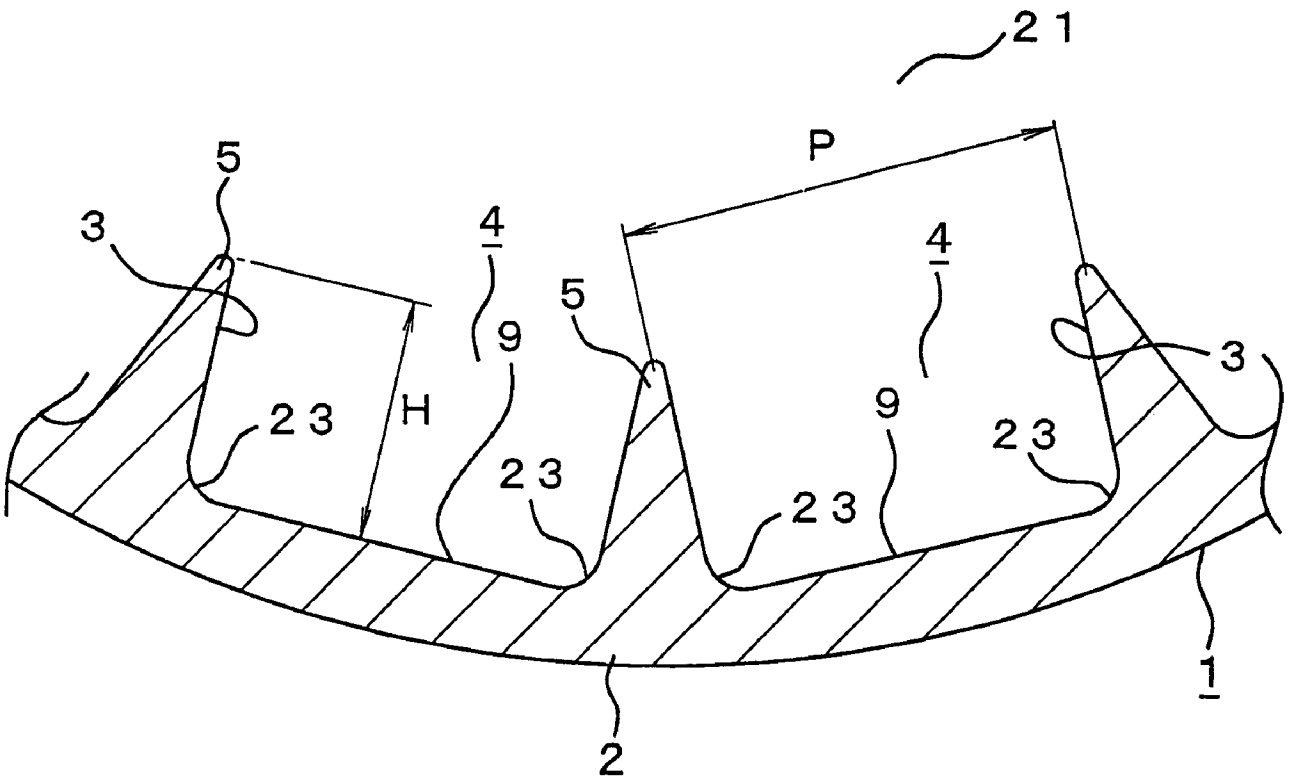
FIG. 10 is an enlarged cross-sectional view of the axially extending groove portion according to the seventh embodiment of the invention.

In the seventh embodiment as shown in FIG. 10, both the bottom portions 9 of the axially extending grooves 4 and the dividing walls 5 thereof are formed in a flat shape, thereby connecting said dividing walls 5 and said bottom portion 9 via arch portions 23 to form the recesses 3. In the first embodiment, the bottom portions 9 and the dividing walls 5 are formed running in the circular shape, thereby making that radius of curvature large, but in the seventh embodiment, the bottom portions 9 and the dividing portions 5 formed in the flat shape are connected via the arch portions 23 with a comparatively small radius of curvature.

Figure 11:
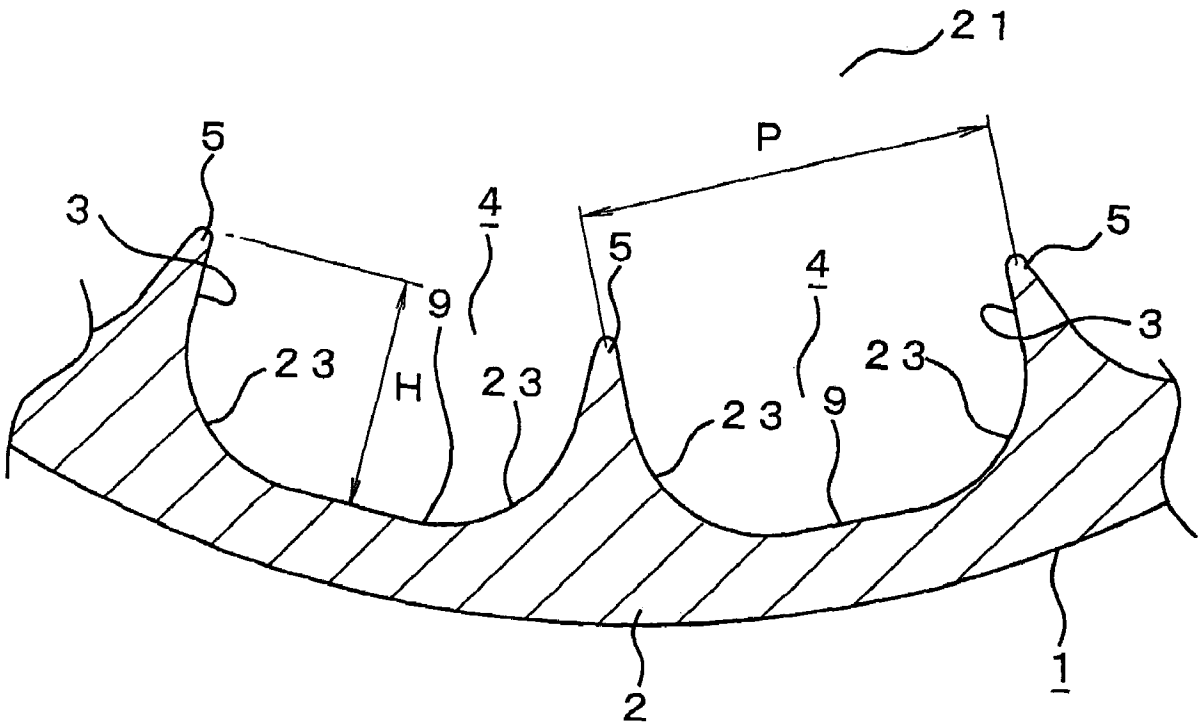
FIG. 11 is an enlarged cross-sectional view of the axially extending groove portion according to the eighth embodiment of the invention.

FIG. 11, shows other different eighth embodiment where the axially extending grooves 4 are formed by the recesses 3 wherein the bottom portions 9 and the dividing walls 5 both formed in the flat shape are connected via arch portions 23. However, in the eighth embodiment, radius of curvature of the arch portion 23 is defined smaller than radius of curvature of the circular recess 3 in the first embodiment but larger than radius of curvature of the arch portion 23 in the seventh embodiment.

In the seventh embodiment and the eighth embodiment as described above, it is also preferable that distance P between the centers of the dividing walls 5 next to each other is defined from 0.2 to 2.0 mm and depth H from the top of the dividing wall 5 is defined from 0.5 P to 1.0 P mm. In the heat conductive pipe 1 formed the axially extending grooves 4 like above thereon, the burst phenomenon that a flowing liquid through the boundary is led with a main flow occurs, so that the separating effect of the soot attached to the surface of the axially extending grooves 4 is improved and exhaust gas containing particles of the soot is hardly subject to entering the inner portions of the axially extending grooves 4 compared to the axially extending grooves 4 having the corner portions 22 as described in the sixth embodiment. Furthermore, only connecting portions between the bottom portions 9 and the dividing walls 5 both formed in the flat shape have to be formed circularly, thus allowing the arch portions 23 to be manufactured without accurateness, thereby being able to be manufactured easily.

FIG. 9, FIG. 10, and FIG. 11 showing from the sixth embodiment to the eighth embodiment show only enlarged views of the base pipe pipes 2 and the axially extending grooves 4 formed on the inner circumferential surface thereof. In the sixth embodiment, the seventh embodiment, and the eighth embodiment, the heat conductive pipe 1 formed without forming the plate-shaped fin member 18 inside the base pipe 2 as same as the first embodiment may be used for the practice. Also, like the second embodiment to the fifth embodiment, the heat conductive pipe 1 is formed by forming the plate-shaped fin member 18 inside the base pipe 2 and the axially extending grooves 4 in an any shape described in the sixth embodiment, the seventh embodiment, and the eighth embodiment are formed on the inner circumferential surface of the base pipe 2 and on the surface of the plate-shaped fin member 18 for the practice.

INDUSTRIAL APPLICABILITY

The present invention is constituted as above, and therefore, it is possible to remove soot attached to a surface of a heat conductive pipe or to prevent the soot from flowing into inner parts of axially extending grooves without reducing a thermal conduction efficiency as a primary object of the heat conductive pipe, neither stopping cooling operation in the heat conductive pipe. Furthermore, the soot can be removed while the soot deposits slightly on the inner surface of the heat conductive pipe. According to an experiment, it is confirmed that a reduction of the thermal conduction rate of the heat conductive pipe due to the soot can be minimized.

In a case where the heat conductive pipe is formed by forming the, plate-shaped fin member on the interior of the base pipe, heat transfer area can be enlarged due to existence of said plate-shaped fin member and due to the: axially extending grooves formed on the plate-shaped fin member and on the base pipe, and furthermore, the thermal conductivity between the plate-shaped fin member and the base pipe is improved, thereby being capable of improving the mutual capability of the thermal exchange between a liquid flowing through the interior of the heat conductive pipe and a liquid flowing through the exterior thereof. Therefore, the great capability of the thermal exchange can be maintained for the superior separating effect of the soot attachment and the minimized reduction of the thermal conduction rate of the heat conductive pipe due to the soot.

What is claimed is:

1. A heat conductive pipe comprising:

a base pipe allowing a liquid to flow though an interior thereof;

a plurality of axially extending grooves, formed parallel to a pipe axis in a row in a circumferential direction on an inner circumferential surface of the base pipe, having a cross section in a recess shape with a prescribed depth; and a plurality of dividing walls formed between the axially extending grooves adjacent to each other having a prescribed thickness, wherein distance P between the centers of the dividing walls next to each other is defined from 0.2 to 2.0 mm and depth H from the top of the dividing wall is defined from 0.5 P to 1.0 P mm.

2. The heat conductive pipe according to claim 1, wherein the base pipe is formed with a long plate-shaped fin member extending in a direction of the pipe axis, and wherein said plurality of the axially extending grooves are formed parallel to the pipe axis in a row on the surface of the plate-shaped fin member and the inner circumferential surface of the base pipe.

3. The heat conductive pipe according to claim 1 or claim 2, wherein the bottom portion of the axially extending groove, formed in a flat shape is connected to the dividing wall via a corner portion.

4. The heat conductive pipe according to claim 1 or claim 2, wherein the bottom portion of the axially extending groove, formed in a flat shape is connected to the dividing wall via an arch portion.

5. The heat conductive pipe according to claim 2, wherein the plate-shaped fin members are formed to divide an inner space of the base pipe into a plural number.

6. The heat conductive pipe according to claim 2 or claim 5, wherein the plate-shaped fin member is formed by folding a plate member provided individually from the base pipe to form a connecting surface thereof being brazed or welded to the inner circumferential surface of the base pipe corresponding to the inner circumferential surface of the base pipe.

7. The heat conductive pipe according to claim 1 or claim 2, wherein the bottom portions of the axially extending grooves and the dividing walls are formed running in a circular shape.

8. The heat conductive pipe according to claim 1 or claim 2, wherein one end of the plate-shaped fin member is connected to the inner circumferential surface of the base pipe and the other end thereof is protruded in the base pipe so as not to contact with the inner circumferential surface of the base pipe.

9. The heat conductive pipe according to claim 8, wherein the plate-shaped fin member is formed by folding a plate member provided individually from the base pipe to form a connecting surface thereof being brazed or welded to the inner circumferential surface of the base pipe.

10. The heat conductive pipe according to claim 8, wherein the plate-shaped fin member and the base pipe are formed in a united body in forming the base pipe.

11. A heat exchanger assembled with a heat conductive pipe, said heat conductive pipe comprising:

the base pipe allowing the liquid to flow thought the interior thereof;

the plurality of axially extending grooves, formed parallel to the pipe axis in a row in the circumferential direction, having the cross section in the recess shape with the prescribed depth; and the plurality of dividing walls formed between the axially extending grooves adjacent to each other having the prescribed thickness, wherein distance P between the centers of the dividing walls next each other is defined from 0.2 to 2.0 mm and depth H from the top of the dividing wall is defined from 0.5 P to 1.0 P mm.

12. The heat exchanger assembled with the heat conductive pipe according to claim 11, wherein the long plate-shaped fin member extending in the direction of the pipe axis is formed in the base pipe, and wherein said plurality of the axially extending grooves having the cross section in the recess shape with the prescribed depth are formed parallel to the pipe axis in a row on the surface of the plate-shaped fin member and the inner circumferential surface of the base pipe.

13. The heat exchanger assembled with the heat conductive pipe according to claim 11 or claim 12, wherein the bottom portion of the axially extending groove, formed in the flat shape is connected to the dividing wall via a corner portion.

14. The heat exchanger assembled with the heat conductive pipe according to claim 11 or claim 12, wherein the bottom portion of axially extending groove, formed in the flat shape is connected to the dividing wall via the arch portion.

15. The heat exchanger assembled with the heat conductive pipe according to claim 11 or claim 12, wherein the bottom portions of the axially extending grooves and the dividing walls are formed in the circular shape.

16. The heat exchanger assembled with the heat conductive pipe according to claim 12, wherein one end of the plate-shaped fin member is connected to the inner circumferential surface of the base pipe and the other end thereof is protruded in the base pipe so as not to contact with the inner circumferential surface of the base pipe.

17. The heat exchanger assembled with the heat conductive pipe according to claim 12, wherein the plate-shaped fin members are formed to divide the inner space of the base pipe into the plural number.

18. The heat exchanger assembled with the heat conductive pipe according to claim 12, claim 16, or claim 17, wherein the plate-shaped fin member is formed by folding the plate member provided separately from the base pipe to form the connecting surface thereof being brazed or welded to the inner circumferential surface of the base pipe corresponding to the inner circumferential surface of the base pipe.

19. The heat conductive pipe according to claim 11 or claim 5, wherein the plate-shaped fin member and the base pipe are formed in a united body in forming the base pipe.

20. The heat exchanger assembled with the heat conductive pipe according to claim 12, claim 16, or claim 17, wherein the plate-shaped fin member and the base pipe are formed in the united body in forming the base pipe.

* * * * *